US005228591A

United States Patent [19]

Jones

[11] Patent Number: 5,228,591

[45] Date of Patent: Jul. 20, 1993

[54] MULTI-COMPARTMENT CONTAINER WITH COLLAPSIBLE BOTTOM FOR MECHANIZED RECYCLABLE-TRASH COLLECTION

[76] Inventor: John S. Jones, 625 N. Norton, Tucson, Ariz. 85719

[21] Appl. No.: 958,817

[22] Filed: Oct. 9, 1992

[51] Int. Cl.[5] ..... B65D 25/04

[52] U.S. Cl. ..... 220/528; 220/262; 220/527; 220/281; 220/909; 222/136; 222/160

[58] Field of Search ..... 222/136, 137, 160, 162, 222/510, 511, 518; 298/1 A, 1 B; 414/406, 408; 232/43.1, 43.4, 43.5; 220/909, 908, 527, 528, 502, 8, 262, 264, 281, 625, 23.4

[56] References Cited

U.S. PATENT DOCUMENTS

| | | | |
|---|---|---|---|
| 367,316 | 7/1887 | Pardee | 232/43.5 |
| 855,939 | 6/1907 | Cronk | 220/629 |
| 1,574,509 | 2/1926 | Oppenhamer | 220/262 |
| 1,921,933 | 8/1933 | Levenberg et al. | 131/51 |
| 1,937,084 | 11/1933 | Janssen | 131/51 |
| 2,228,008 | 1/1941 | Groff | 220/576 |
| 2,495,505 | 1/1950 | Bella | 232/43.1 |
| 2,501,061 | 3/1950 | Leong | 220/262 |
| 2,599,722 | 6/1952 | Rourke, Jr. et al. | 194/9 |
| 2,606,699 | 8/1952 | Andricks | 222/518 |
| 2,612,313 | 9/1952 | Williamson | 232/43.1 |
| 2,628,000 | 2/1953 | MacKenzie | 222/162 |
| 2,817,476 | 12/1957 | Mills, Jr. | 232/43.1 |
| 3,543,814 | 12/1970 | Aluotto | 222/162 |
| 3,904,218 | 9/1975 | Kostic | 280/79.2 |
| 4,997,102 | 3/1991 | Bolling | 220/325 |
| 5,156,296 | 10/1992 | Vasquez | 220/909 |
| 5,160,063 | 11/1992 | Bailey | 220/8 |

*Primary Examiner*—Stephen P. Garbe
*Assistant Examiner*—S. Castellano
*Attorney, Agent, or Firm*—Antonio R. Durando; Harry M. Weiss

[57] ABSTRACT

A multi-compartment trash container that comprises two main components. An inner core consists of a circular bottom plate with a convex surface sloped downward toward the perimeter of the container and several vertical baffles connected to a common vertical shaft extending upward from the center of the bottom plate, so that wedge-like sections with slanted bottoms are formed around the vertical axis of the container. An outer cover consists of a conforming bottomless cylindrical structure having a top end with openings corresponding to the sections in the inner core and a collar at the center for slidably engaging the top of the vertical shaft in the inner core. Thus, the outer cover is slidably mounted on the inner core to form a container with multiple enclosed compartments and a spring-loaded push-plate is provided at the top of the shaft to push the inner core downward with respect to the outer cover. An outward annular flange attached to the bottom edge of the cylindrical structure provides a base for supporting the outer cover while the inner core is made to slide downward through an appropriately sized hopper to discharge its contents into a collection vehicle. A specially designed handle makes it possible for a mechanized arm on the vehicle to lift the container and correctly align it for positioning on the hopper.

11 Claims, 2 Drawing Sheets

MULTI-COMPARTMENT CONTAINER WITH COLLAPSIBLE BOTTOM FOR MECHANIZED RECYCLABLE-TRASH COLLECTION

BACKGROUND OF THE INVENTION

1. Field of the Invention

This invention pertains to the general field of trash bins and containers. In particular, it provides a new and improved compartmentalized container suitable for mechanized collection of different types of recyclable articles.

2. Description of the Prior Art

Many different kinds of trash cans and bins have been developed over the years to meet particular needs of users. In order to facilitate the disposal of trash from waste containers, possibly without touching it, various bottom-dump models have been developed, both for home and industrial use. Similarly, various types of lids have been designed to maximize protection from odors and contamination while minimizing contact with the trash.

With the increased environmental awareness of the general public and popularity of recycling certain used articles, multi-compartment trash cans have also become common. By sorting the trash into distinct classes of recyclable items at the time of disposal, such as by storing glass, aluminum and plastic into separate compartments, the recycling operation is greatly simplified because each compartment can be dumped separately into the appropriate collection bin. At the household level, this is proving to be a very efficient way for immediately separating various recyclable items for periodic pick-up by waste management authorities.

The prior art shows numerous types of garbage cans with some of these features. For example, U.S. Pat. No. 2,495,505 to Bella (1950) discloses an elevated garbage container with a removable bottom hinged to the lower rim. The bottom is opened by swinging it downward by means of a lever mechanism, thus enabling a user to dump its contents into a collection truck.

U.S. Pat. No. 2,599,722 to Rourke et al. (1952) shows a multicompartment container for depositing clothing or other articles. The relevance of this patent is limited to the idea of using partitions inside a receptacle to create a multifunctional structure.

In U.S. Pat. No. 2,817,476 (1957), Mills discloses a garbage can with a bottom fastened to the body of the can by means of latches positioned around the bottom rim. The bottom can be opened through a lever and the contents of the can may be dumped without further handling of the material. The idea is to permit the transfer of trash from a first disposal container to a more permanent one with a minimum of contact with the material disposed.

U.S. Pat. No. 3,904,218 to Kostic (1975) describes a trash-can unit formed by combining several containers having compatible geometries into a single unit under a common lid. This invention does not include a removable or otherwise mechanically operable bottom.

U.S. Pat. No. 4,997,102 to Bolling (1991) describes a lid for a multicompartment trash container. The lid contains apertures of different sizes to help sort different types of articles that a user wishes to separate.

In related apparatus, U.S. Pat. No. 1,921,933 to Levenberg et al. (1933) discloses a smoking stand having an ash collection container with a collapsible bottom. A lever-arm mechanism connected to a shaft permits a user to open the bottom of the container and dump its contents when the stand is full.

In U.S. Pat. No. 1,937,084 (1933), Janssen describes an ashtray/receptacle combination comprising a tray and an ash storage receptacle positioned below the cigarette level. The lid of the receptacle constitutes the bottom of the tray and can be dropped to allow the ashes to fall into the receptacle. The movement of the lid is controlled by a spring-loaded mechanism.

Finally, U.S. Pat. No. 2,612,313 (1952) to Williamson describes another smoking stand featuring an ashtray with a spring-loaded bottom that can be lowered to dump the ashes in a lower container. In different embodiments of the invention, the same mechanism is used to selectively open also the bottom of the lower container, thus permitting the periodic disposal of its contents.

It is apparent that much effort has been dedicated to provide apparatus that facilitates the manual separation and disposal of trash items, whereby each class of recyclables is readily transferred from a trash container to separate bins for collection by waste management authorities or for distribution to recycling centers. The main problem in handling recyclable items, though, remains at the collection stage, where separate types of items need to be identified visually and dumped manually into separate bins of the collection vehicle. The separate handling of individual classes of recyclable articles is labor intensive, time consuming and expensive, often rendering the entire recycling process uneconomical. Therefore, there is a need for a multi-compartment trash container that can be emptied mechanically by the t collection vehicle and that automatically delivers each type of recyclable items to a separate collection compartment in the vehicle.

BRIEF SUMMARY OF THE INVENTION

One objective of this invention is a multi-compartment trash container that can be used at the household level to store different kinds of recyclable items in separate cells within the container.

Another goal of the invention is a trash container that can be picked up by a mechanical arm on a collection vehicle and automatically aligned for disposal of each type of recyclable material into separate collection bins.

Another objective is trash container that can be opened automatically by a mechanical device once properly positioned on the collection vehicle, with minimal opportunity for spillage and mixing of the articles.

Yet another goal is a container with a geometry that permits its automatic lifting from the side of the road by apparatus on a collection vehicle, its alignment and placement on a receiving hopper, the opening of its bottom to discharge the material and, finally, its placement back on the road, wherein all is accomplished in a stable, efficient and rapid manner.

Finally, a further goal of the invention is the realization of the above mentioned goals in an economical and commercially viable manner, which is achieved by utilizing components that are either already available in the open market or that can be produced at competitive prices.

To the accomplishment of these and other objectives, this invention consists of a multi-compartment trash container that comprises two main components. An inner core consists of a circular bottom plate with a convex surface sloped downward toward the perimeter of the container and several vertical baffles connected to a common vertical shaft extending upward from the center of the bottom plate, so that wedge-like sections with slanted bottoms are formed around the vertical axis of the container. An outer cover consists of a conforming bottomless cylindrical structure having a top end with openings corresponding to the sections in the inner core and a collar at the center for slidably engaging the top of the vertical shaft in the inner core. Thus, the outer cover is slidably mounted on the inner core to form a container with multiple enclosed compartments and a spring-loaded push-plate is provided at the top of the shaft to push the inner core downward with respect to the outer cover. An outward annular flange attached to the bottom edge of the cylindrical structure provides a base for supporting the outer cover while the inner core is made to slide downward through an appropriately sized hopper to discharge its contents into a collection vehicle. A specially designed handle makes it possible for a mechanized arm on the vehicle to lift the container and correctly align it for positioning on the hopper.

Various other purposes and advantages of this invention will become clear from its description in the specification that follows, and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose only one of the various ways in which the invention may be practiced.

DETAILED DESCRIPTION OF THE INVENTION

This invention involves the combination of several known mechanical principles to develop a multi-compartment trash container that is suitable for mechanized collection of recyclable material. To that end, the container must enable a user to keep different kinds of recyclable articles separate in the container itself; to lift from ground level, align, and position the container on a collection vehicle so that different items are automatically discharged into separate receiving compartments in the vehicle; and to reposition the container on the ground with a totally mechanized sequence of operations.

Figure 1:
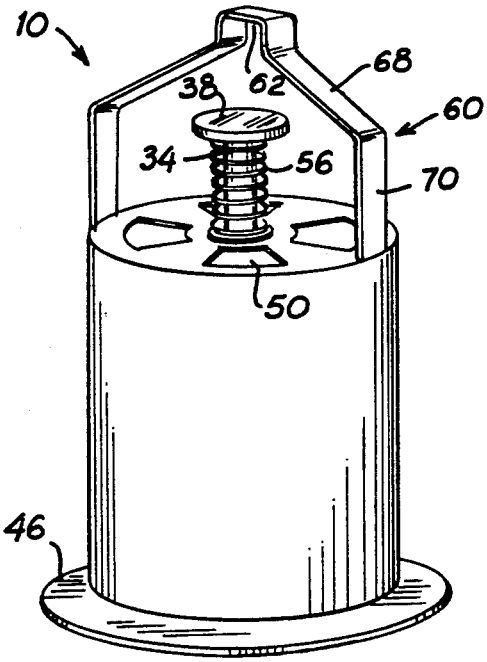
FIG. 1 is a perspective front view of a multi-compartment trash can according to an embodiment of the present invention.
Figure 2:
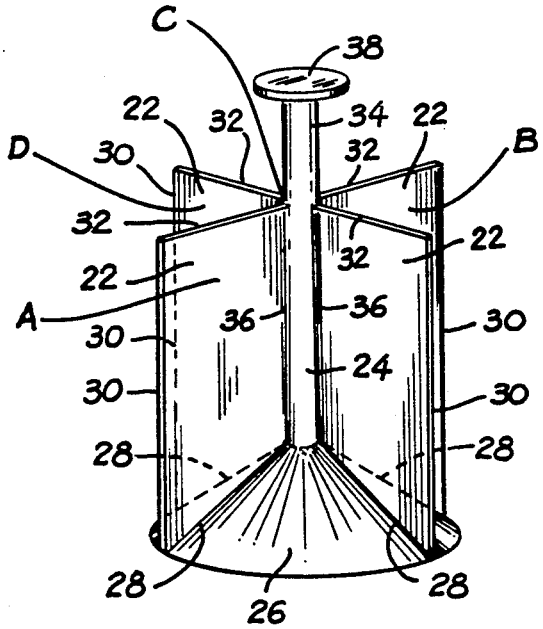
FIG. 2 is a perspective front view of the inner core component of the trash can of FIG. 1, illustrating vertical baffles mounted on a conical bottom to form separate sloped-bottom compartment sections.

Referring to the drawings, wherein like parts are designated throughout with like numerals and symbols, an embodiment of the trash container 10 of this invention is illustrated in FIG. 1. The container 10 comprises two substantially distinct components, an inner core and an outer cover, that are slidably connected to one another. As illustrated in FIG. 2, the inner core 20 consists of multiple vertical baffles 22 of equal dimensions extending radially (outwardly) from a vertical axially-located support structure or shaft 24. The base 26 of the inner core consists of a convex circular plate having an apex substantially coaxial with the shaft 24 and attached to the bottom edge 28 of each baffle 22, so as to provide a bottom surface sloping downward toward the outer perimeter of the plate. The pitch of the slope needs to be sufficiently steep to cause articles packed on top of the bottom plate to slide out by gravity when a sufficiently large opening is created between baffles around the bottom of the container (that is, a slope greater than the angle of repose of the material). It is found that a 45 degree angle is generally sufficient for the typical kind of household article stored for recycling.

The outer edge 30 of each baffle is straight and vertical, thus defining multiple wedge-like sections with a sloped bottom, each corresponding to a separate compartment of the trash can of the invention. For simplicity of illustration the drawings show four baffles disposed at 90 degrees of each other, thus defining four equal-size wedges, but a different number of baffles with any spacing could obviously be used equivalently to practice the invention, so long as sufficient baffles are present to provide a support structure for the outer cover. The critical features are the requirements that the baffles define separate compartments having a bottom sloped toward the outside and vertical outer edges capable of cooperatively sliding in and out of the outer cover.

As will become apparent from the description of the operation of the trash container 10, the vertical shaft 24 must extend above the top edges 32 of the baffles 22 by a portion of the shaft or neck 34 at least as long as the approximate height of the largest article planned for storage in the container. The neck 34 is preferably circular in cross-section and is the only essential part of the shaft 24. As would be obvious to one skilled in the art, the lower portion of the shaft is described only as a convenient anchor for connecting the various baffles 22 along the inner core's main axis, but a direct connection between the inner edges 36 of adjacent pairs of baffles, such as by welding or single-piece molding could provide an equivalent axial structure to assemble the various parts. Finally, the inner core 20 comprises a horizontal push-plate 38 rigidly attached over the top end of the neck 34 of the shaft, so that it can be used to exert downward pressure on the shaft and, thereby, on the entire inner core assembly.

Figure 3:
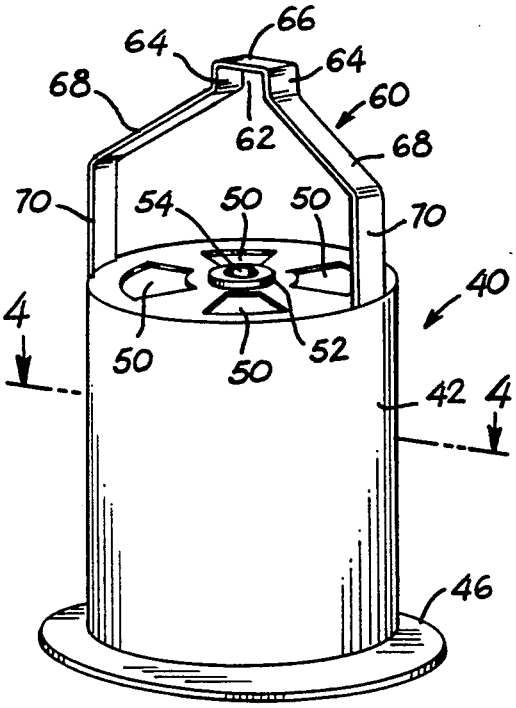
FIG. 3 is a perspective front view of the outer shell of the trash can of FIG. 1, illustrating a multi-compartment lid and a handle specially designed to ensure the automatic alignment of the can on a supporting mechanical arm.
Figure 4:
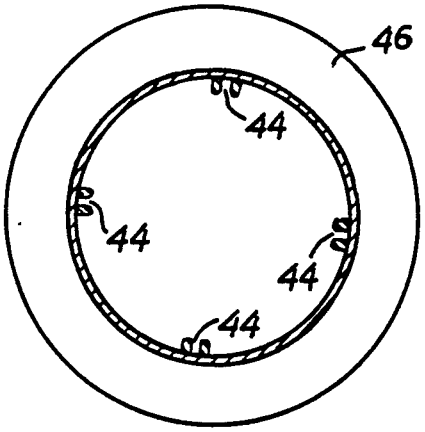
FIG. 4 is a cross-sectional view of the outer cover of the invention taken from line 4—4 in FIG. 3, illustrating tracks on the inner surface of the cover for slidable engagement with the baffles in the inner core.
Figure 8:
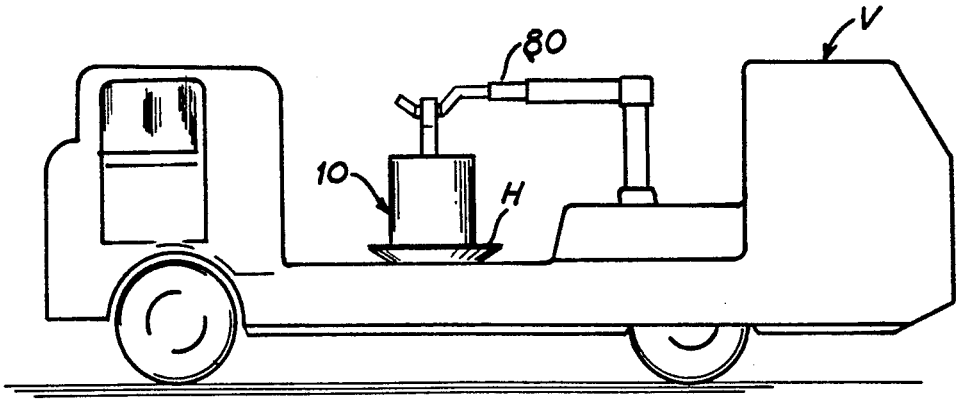
FIG. 8 is a schematic view of a trash collection vehicle illustrating the use of the trash can of the invention to automatically transfer its multi-compartment contents into a receiving hopper on the bed of the vehicle.

FIG. 3 shows an embodiment of the outer cover 40 that conforms to the inner core 20 described above. It consists of a cylindrical shell 42 with a diameter slightly larger than that of the inner core's base 26 and, correspondingly, than the radial dimensions of the baffles 22, so that the shell can smoothly slide over the inner core 20 to form the multiple-compartment container of the invention. As would be apparent to those skilled in the art, the height and top shape of the shell 42 need to be the same as those of the baffles 22 in order to have a good fit of the cover 40 over the inner core 20. As shown in FIG. 4, a system of vertical tracks 44, or equivalent means, is provided for engaging the baffles 22, so that their proper alignment can be maintained with respect to the cover 40, and for guiding the slidable motion of the outer cover over the baffles. While the space inside of the bottom edge of the shell 42 is left open for engagement with the inner core 20, an outward annular flange or lip 46 is attached to the outside of the bottom edge to provide a base for improving the stability of the container. In particular, as will be explained in more detail below, the flange 46 is used to support the shell 42 while the inner core is made to slide downward through an appropriately sized hopper to discharge its contents on a collection vehicle (illustrated in FIG. 7).

The top end of the shell 42 is covered with a permanently attached, rigid lid 48 having multiple openings 50, preferably covered by spring-loaded hinged shutters for convenience, corresponding to each compartment between pairs of baffles in the inner core 20. Thus, different kinds of articles may be stored separately by inserting them through separate corresponding openings 50. A vertical collar 52, containing a vertical bore 54 sized to match the neck 34, is provided at the center of the lid 48 for receiving in slidable engagement the neck 34 of the inner core's shaft 24. The bore 54 is illustrated as circular in the drawings to conform to the chosen geometry for the neck 34, but obviously any compatible cross-sectional shape of the neck and bore would be acceptable. In assembling the container 10 of the invention, prior to permanently affixing the push-plate 38 to the top end of the neck 34, the outer cover 40 is lowered over the inner core 20 with the outer edges 30 of the baffles sliding in the tracks 44 of the shell, and the neck 34 is inserted into the bore 54 to protrude vertically above the lid 48. Then a spring 56 is inserted around the neck 34, between the collar 52 and the push-plate 38, as seen sufficient to overcome the weight of the trash container when fully loaded, so that the bottom of the container will not open when it is lifted by the handle. Thus, the spring 56 ensures that the trash container 10 is closed (that is, the shell 42 is completely down over the inner core 20), unless the inner core is pushed down against the pressure of the spring 56.

Figure 5:
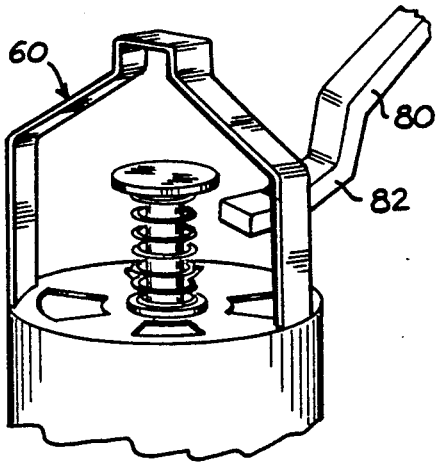
FIG. 5 is a perspective front view of the top portion of the trash can and the tip of a mechanical arm shown in the process of engaging the handle of the can.

Finally, the cover 40 features a specially designed handle 60 that is rigidly attached to the top rim of the cover at the edge between the lid 48 and the shell 42. The purpose of the handle 60 is not only to provide an anchor or structure for use in lifting the trash container of the invention, but also to provide a mechanism for the automatic alignment of the container with a mechanical arm 80 engaging the handle for lifting the container onto a collection vehicle, as illustrated in FIG. 5. Thus, the specific geometry of the handle 60 must be compatible with the corresponding geometry of the lifting arm on the collection equipment and different configurations may be devised to achieve the same result, but the handle and arm must be shaped in such a way that the container will orient itself properly once grabbed and lifted by the arm. In the preferred embodiment illustrated in the figures, the handle 60 features a rectangular channel 62 positioned directly above the push-plate 38 and formed by rigidly attaching two vertical plates 64 to a horizontal plate 66 several inches long and wide. Each vertical plate 64 is then rigidly attached to a slanted plate 68 sloped radially downward toward the outside and itself attached to a peripheral vertical plate 70 extending upward from the upper rim of the lid 48. It is important that the slope of the slanted plates 68 be sufficient to cause the container to slide by its own weight over a horizontal rigid beam, such as the mechanical arm 80 illustrated in FIG. 5, placed under the handle to lift the container 10. It is also important that the two vertical plates 70 rise to a height at least approximately equal to the position of the push-plate 38, so that sufficient space is present between the push-plate and each slanted plate 68 for the arm 80 to slide unobstructedly toward the channel 62 at the top of the handle.

In order to automatically effect the desired positioning of the trash container, it is also essential that the mechanical arm 80 be able to lock the handle 60 in place with the desired orientation and at the desired precise point along the length of the arm. This can be achieved by having an arm comprising a horizontal portion 82 with a cross-section conforming with the geometry of the channel 42 and attached to two slanted portions 84 of similar size and geometry, so that the handle will slide over the arm 80 and the channel 62 will automatically fit over the horizontal portion 82 when the trash container 10 is lifted by the mechanical arm 80.

Although various degrees of slant for the plates 68 and the portions 84 may be equivalently appropriate to practice the invention, I found that a 45 degree angle is suitable for either steel or plastic, the materials most likely to be used to manufacture the handle and tip portion of the mechanical arm.

Figure 6A:
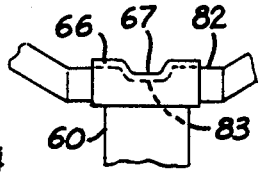
FIG. 6*a* is a partial side view of a notched embodiment of the handle of the invention.
Figure 6:
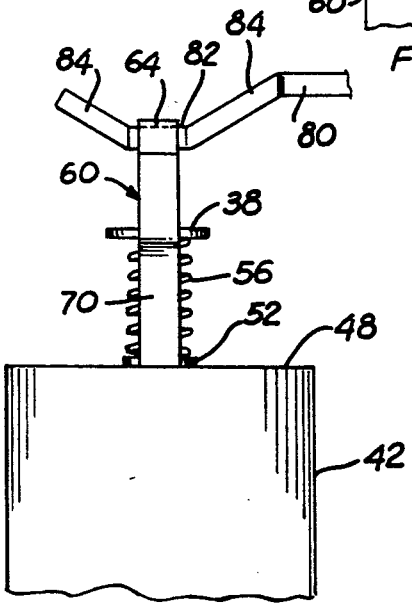
FIG. 6 is a perspective side view of the top portion of the trash can and the tip of a mechanical arm illustrating the cooperative locking position between the handle and the arm that results upon lifting of the can.
Figure 7:
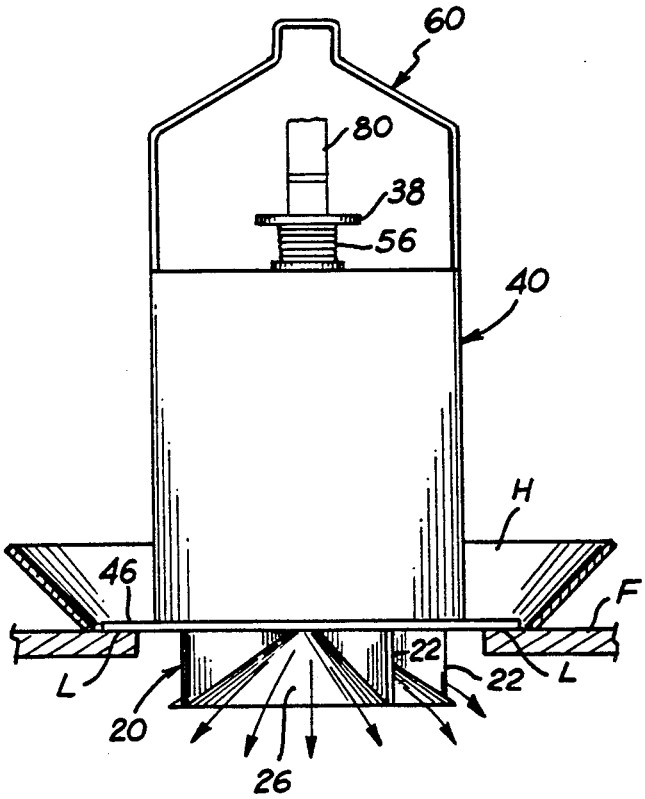
FIG. 7 is an elevational view of the trash can of the invention positioned over a partially sectioned hopper and illustrating a mechanical arm pressing on the push-plate to open the bottom of the can and release its contents.

Thus, as illustrated in FIGS. 5–8, it is envisioned that a mechanical arm 80 mounted on a collection vehicle V and having a tip with the characteristics described above would be guided by the driver of the vehicle through the handle 60 of the invention, as seen in FIG. 5, and then lifted to allow the container to slide into position. As shown in the side view of FIG. 6, the container will naturally slide by gravity until the channel 62 has converged over the horizontal portion 82 of the lifting arm, where it becomes locked in place. A notch 83 and a corresponding inset 67 in the horizontal plate 66 may be added to further increase the locking between the two, as illustrated in the partial side view of FIG. 6*a*. The arm 80, which preferably comprises several vertical and horizontal hydraulic segments for versatility of motion in multiple directions, then swings the container 10 and lowers it over a hopper H mounted over a receiving bin in the bed or floor F of the collection vehicle. As seen in FIG. 7, the bottom of the hopper features a horizontal lip L extending inward from the edge and slightly larger than the diameter of the flange 46 for supporting the flange (and therefore the trash container) after it has been lowered by the arm 80 The diameter of the inner edge of lip L is larger than the bottom plate 26 of the inner core of the invention, so that the plate may be lowered through the lip into the bin below. Once the container is in place, the mechanical arm 80 is lowered to press against the push-plate 38 and causes the inner core 20 of the trash container to be partially extracted from the shell 40 through the bottom of the hopper, thus opening the bottom of each trash-container compartment to release its contents, as seen in FIG. 7. Obviously, a multi-compartment bin corresponding to the size and geometry of the container must also be present in the collection vehicle in order to maintain the separation of the various recyclable articles so collected. FIG. 7 illustrates in partial cross-section the effect of the arm 80 pushing the bottom of the container 10 open by pressing the push-plate 38 down against the opposing force of the spring 56. It is anticipated that a vibrator in the bed of the vehicle may also be used to facilitate the discharge of the trash container so disposed. Finally, the downward pressure is released as the arm 80 is lifted and the handle is again picked up for repositioning of the container at ground level, with a reverse sequence of steps then described for the loading operation.

In order for the trash container of this invention to work, it is obviously essential that a compatible system of collection and storage be used in the collection vehicles. The size and shape of the compartments in the receiving bin must be designed to house the corresponding expected volume of recyclable material.

Similarly, the mouth of each bin compartment must be consistently aligned with the corresponding compartment in the trash container. This can be achieved by standardizing the position of each compartment in the container with reference to the handle and by having the same relative position reflected in the bin with reference to the lifting arm. In a container having four equal-size compartments A, B, C and D, for example, the waste management authorities may decide that A will be used for dark glass, B for clear glass, C for plastic and D for aluminum. Furthermore, the handle 60 of each container will have an identifiable (such as by colored markings) front side that must be positioned toward the street when the container is set out for collection, so that the handle of the container will be engaged by the mechanical arm from the front side only. With reference to the handle, the four compartments could be A and B from left to right in the back and C and D from right to left in front. Thus, once the arm 80 has picked up the container and the handle 60 is correctly locked in place, the position of each compartment is fixed also with respect to the arm 80 and, correspondingly, with respect to the various compartments in the bin of the vehicle. Thus, the release of each set of recyclable items to the correct bin compartment is automatically ensured.

In the preferred embodiment of the invention, it is expected that the container 10 will have four or five compartments of equal dimensions. The size of the container will be comparable to the average size of the trash containers currently available for mechanized collection; that is, about four feet tall and three feet in diameter, for a total capacity between 50 to 60 gallons. A channel 62 approximately eight inches long, four inches wide and four inches deep ensures sufficient stability for the handle of the invention to be picked up by a mechanical arm of the type herein described and loaded onto a collection vehicle.

Various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus and methods.

I claim:

1. A multi-compartment container with a collapsible bottom for the storage and mechanized collection of recyclable articles, comprising:

(a) an inner core consisting of multiple vertical baffles extending radially from an axial structure mounted on a convex base having an apex substantially coaxial with said axial structure, so as to provide a bottom surface sloping downward toward the outside of the core; wherein, the slope of said convex base is sufficiently steep to cause the articles packed on top of the base to slide out by gravity; and wherein each of said baffles has a straight and vertical outer edge, thus defining multiple wedge-shaped sections with a sloped bottom;

(b) a vertical neck coaxial with said axial structure and extending above said baffles by a length at least as great as the approximate height of a largest article planned for storage in the container;

(c) an outer cover conforming to the geometry of said inner core and comprising a bottomless shell having a top edge and a bottom edge and a cross-section slightly larger than that of the inner core, so that the shell can smoothly slide over the inner core to form the multiple-compartment container;

(d) a system of vertical members attached to said shell for engaging said multiple vertical baffles for guiding the slidable motion of the outer cover over the inner core;

(e) an outward annular flange attached to the bottom edge of said shell;

(f) a rigid lid attached to the top edge of said bottomless shell and having multiple openings corresponding to each compartment between pairs of baffles in the inner core, and having a centrally-positioned vertical collar containing a vertical bore sized to receive said neck in slidable engagement therewith;

(g) a horizontal push-plate attached to said neck;

(h) a spring inserted around said neck, between said collar and said push-plate, to provide constant expansive pressure therebetween sufficient to overcome the weight of the container when fully loaded; and (i) a handle rigidly attached to said outer cover to provide an anchor for a mechanical arm on collection equipment, so that the mechanical arm is able to lock the handle, lift the container, place the container on a receiving hopper with the desired orientation, and release the recyclable articles stored therein into separate compartments of a receiving bin by pressing downward on said push-plate.

2. The multi-compartment container described in claim 1, wherein said multiple vertical baffles have equal dimensions.

3. The multi-compartment container described in claim 2, wherein said multiple vertical baffles consist of four equal baffles disposed at 90 degrees of each other.

4. The multi-compartment container described in claim 1, wherein the slope of said convex base is approximately 45 degrees.

5. The multi-compartment container described in claim 1, wherein said vertical neck and vertical collar have a circular cross-section.

6. The multi-compartment container described in claim 1, wherein said bottomless shell is cylindrical with a diameter slightly larger than the radial dimensions of said baffles.

7. The multi-compartment container described in claim 1, wherein each of said multiple openings is covered by a spring-loaded hinged shutter.

8. The multi-compartment container described in claim 1, wherein said handle consists of a rectangular channel centrally-positioned directly above said push-plate and formed by rigidly attaching two upper vertical plates to a horizontal plate, wherein each of the vertical plates is rigidly attached to a slanted plate that is sloped radially downward toward the outside of the container and that is itself attached to a lower peripheral vertical plate extending upward from said lid; wherein the slope of said slanted plates is sufficient to cause the container to slide by its own weight over the mechanical arm placed under the handle to lift the container; and wherein said two upper vertical plates rise to a height above said lid at least approximately equal to the position of the push-plate, so that sufficient space is present between the push-plate and each slanted plate for the mechanical arm to slide unobstructedly toward the channel above the push-plate.

9. The multi-compartment container described in claim 8, wherein said rectangular channel is about eight inches long, four inches wide and four inches deep.

10. The multi-compartment container described in claim 9, wherein said slanted plates are disposed at an angle of approximately 45 degrees.

11. A multi-compartment container with a collapsible bottom for the storage and mechanized collection of recyclable articles, comprising:

(a) an inner core consisting of multiple vertical baffles of equal dimensions extending radially from an axial structure mounted on a convex base having an apex substantially coaxial with said axial structure, so as to provide a bottom surface sloping downward toward the outside of the core; wherein the slope of said convex base is sufficiently steep to cause the articles packed on top of the base to slide out by gravity; and wherein each of said baffles has a straight and vertical outer edge, thus defining multiple wedge-shaped sections with a sloped bottom;

(b) a vertical neck coaxial with said axial structure and extending above said baffles by a length at least as great as the approximate height of a largest article planned for storage in the container, wherein said neck has a circular cross-section;

(c) an outer cover conforming to the geometry of said inner core and comprising a bottomless cylindrical shell having a top edge and a bottom edge and a cross-section slightly larger than that of the inner core, so that the shell can smoothly slide over the inner core to form the multiple-compartment container;

(d) a system of vertical members attached to said shell for engaging said multiple vertical baffles for guiding the slidable motion of the outer cover over the inner core;

(e) an outward annular flange attached to the bottom edge of said shell;

(f) a rigid lid attached to the top edge of said bottomless shell and having multiple openings corresponding to each compartment between pairs of baffles in the inner core, and having a centrally-positioned vertical collar containing a vertical circular bore sized to receive said neck in slidable engagement therewith, wherein each of said multiple openings is covered by a spring-loaded hinged shutter;

(g) a horizontal push-plate attached to said neck;

(h) a spring inserted around said neck, between said collar and said push-plate, to provide constant expansive pressure therebetween sufficient to overcome the weight of the container (i) a handle rigidly attached to said outer cover to provide an anchor for a mechanical arm on collection equipment, said handle consisting of a rectangular channel about eight inches long, four inches wide and four inches deep and centrally-positioned directly above said push-plate, wherein said channel is formed by rigidly attaching two upper vertical plates to a horizontal plate, each of the vertical plates being rigidly attached to a slanted plate that is sloped radially downward toward the outside of the container and each of said slanted plates being attached to a lower peripheral vertical plate extending upward from said lid; wherein the slope of said slanted plates is sufficient to cause the container to slide by its own weight over the mechanical arm placed under the handle to lift the container; and wherein said two upper vertical plates rise to a height above said lid at least approximately equal to the position of the push-plate, so that sufficient space is present between the push-plate and each slanted plate for the mechanical arm to slide unobstructedly toward the channel above the push-plate.

* * * * *

UNITED STATES PATENT AND TRADEMARK OFFICE

CERTIFICATE OF CORRECTION

PATENT NO. : 5,228,591

DATED : JULY 20, 1993

INVENTOR(S) : JOHN S. JONES

It is certified that error appears in the above-identified patent and that said Letters Patent is hereby corrected as shown below:

Column 10, claim 11, line 31, after "container", insert --when fully loaded; and--.

Signed and Sealed this

Fifteenth Day of February, 1994

*Attest:*

*Attesting Officer*

BRUCE LEHMAN

*Commissioner of Patents and Trademarks*